US006264535B1

(12) United States Patent
Chang et al.

(10) Patent No.: US 6,264,535 B1
(45) Date of Patent: Jul. 24, 2001

(54) WAFER SAWING/GRINDING PROCESS

(75) Inventors: Shi-Yu Chang; Chin-Te Chen, both of Taichung Hsien; Wen-Ta Tsai, Taichung, all of (TW)

(73) Assignee: Siliconware Precision Industries Co., Ltd., Taichung Hsien (TW)

( * ) Notice: Subject to any disclaimer, the term of this patent is extended or adjusted under 35 U.S.C. 154(b) by 0 days.

(21) Appl. No.: 09/404,500

(22) Filed: Sep. 23, 1999

(30) Foreign Application Priority Data

Aug. 11, 1999 (TW) ..... 88113715

(51) Int. Cl.[7] ..... B24B 1/00

(52) U.S. Cl. ..... 451/28; 451/41; 451/54; 29/412; 29/413; 29/414; 29/415; 29/417

(58) Field of Search ..... 451/41, 54, 28; 29/412, 413, 414, 415, 417

(56) References Cited

U.S. PATENT DOCUMENTS 5,622,900 * 4/1997 Smith ..... 438/464
5,872,046 * 2/1999 Kaeriyama et al. ..... 438/465
5,964,210 * 10/1999 Hodsden ..... 451/299

* cited by examiner

*Primary Examiner*—David A. Scherbel
*Assistant Examiner*—Shantese McDonald
(74) *Attorney, Agent, or Firm*—J.C. Patents; Jiawei Huang

(57) ABSTRACT

A wafer sawing/grinding process capable of removing cracks and chipping resulted from a wafer sawing operation. A silicon wafer having an active surface and a back surface is provided. A first tape is attached to the back surface of the wafer and then the wafer is sawn along kerfs between neighboring silicon chips. A second tape is attached to the active surface of the silicon wafer before removing the first tape. The back surface of the wafer is then ground until the wafer reaches a desired thickness. A third tape is attached to the ground back surface of the wafer before removing the second tape.

11 Claims, 3 Drawing Sheets

WAFER SAWING/GRINDING PROCESS

CROSS-REFERENCE TO RELATED APPLICATION

This application claims the priority benefit of Taiwan application serial no. 88113715, filed Aug. 11, 1999, the full disclosure of which is incorporated herein by reference.

BACKGROUND OF THE INVENTION

1. Field of Invention

The present invention relates to a wafer sawing/grinding process. More particularly, the present invention relates to a wafer sawing/grinding process capable of removing cracks and chipping on the back surface of a silicon chip due to a wafer sawing operation.

2. Description of Related Art

Nowadays, most semiconductor devices are formed over a single-crystal silicon wafer. To increase production and lower production cost, the diameter of a silicon wafer has gradually increased from 4 inches in the past to 8 inches currently. Consequently, more silicon chips can be squeezed over a single wafer. However, due to limitations of the sawing operation and deformations preventions during pressure and thermal processing, an 8-inch silicon wafer must have a thickness at least between 700 to 800 micrometers.

In conventional semiconductor manufacturing process, a silicon wafer is first polished to form a mirror surface. The mirror surface of the silicon wafer then undergoes a series of operations including deposition, photolithographic operation, etching, doping and thermal processing to form devices and interconnections. In order to form a thin and lightweight package such as a thin small outline package (TSOP), the thickness of the silicon wafer must be further reduced. Therefore, before the silicon chips are sawn out for packaging, a tape is attached to the active surface of the wafer and the back surface is then ground until a thickness of about 100 to 300 micrometers. After the grinding operation, the tape is removed from the active surface. Another tape is attached to the back surface of the wafer and wafer sawing is carried out from the active surface to form a plurality of individual silicon chips. Since the area-to-thickness ratio increases tremendously after wafer grinding, transportation of the ground wafer and the process of removing tape from the active surface and the subsequent attachment of tape on the back surface of the wafer often produce cracks on the wafer.

Conventionally, wafer sawing is conducted after the thickness of the wafer has been reduced by grinding. FIG. 1 is a schematic cross-sectional view of a sawn wafer produced by a conventional process. The cutting of silicon wafer is usually done by running the sawing blade from the active surface 12 of the wafer 10 along kerfs 18 between silicon chips 16 down towards the back surface 14. Because thickness of the wafer has been reduced by grinding, stress created during the sawing operation often produces cracks 20 on the back surface 14 adjacent to the kerfs 18. FIG. 2 is a perspective view of one of the silicon chips in the wafer shown in FIG. 1. Aside from cracks 20, chipping 22 also contribute additional damages to the back surface 14 of the silicon chip 16. In subsequent chip packaging operations such as a molding or encapsulation, and assembly operations such as surface mounting of the package, the silicon chip 16 is heated. Due to heating, the cracks 20 on the silicon chip 16 may extend. Ultimately, reliability of the product is compromised.

SUMMARY OF THE INVENTION

Accordingly, one object of the present invention is to provide a wafer sawing/grinding process capable of preventing crack formation due to a sawing operation.

A second object of this invention is to provide a wafer sawing/grinding process capable of removing cracks and chipping that resulted from a sawing operation.

To achieve these and other advantages and in accordance with the purpose of the invention, as embodied and broadly described herein, the invention provides a wafer sawing/grinding process. First, a silicon wafer having an active surface and a back surface is provided. A first tape is attached to the back surface of a silicon wafer and then the wafer is sawn along the kerf between neighboring silicon chips. A second tape is attached to the active surface of the silicon wafer before removing the first tape. The back surface of the wafer is ground until the wafer reaches a desired thickness. Finally, a third tape is attached to the ground back surface of the wafer before removing the second tape.

Because the back surface is ground only after the wafer is sawn, any cracks or chipping formed during the sawing operation can be removed by grinding. Moreover, the wafer has a greater thickness when the wafer is sawn. Hence, cracking of the silicon chips is minimized.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
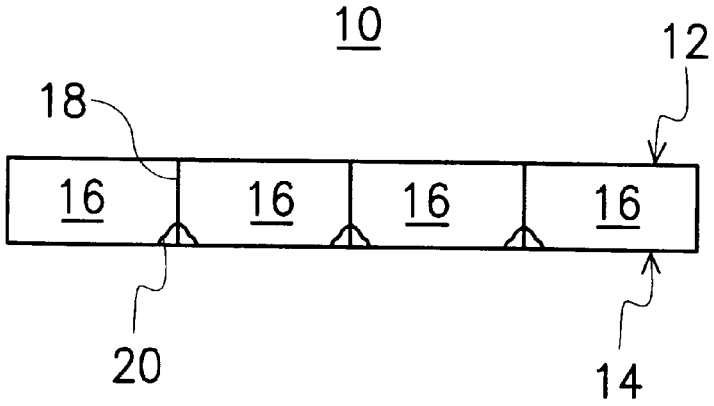
FIG. 1 (PRIOR ART)
FIG. 1 is a schematic cross-sectional view of a sawn wafer produced by a conventional process.
Figure 2:
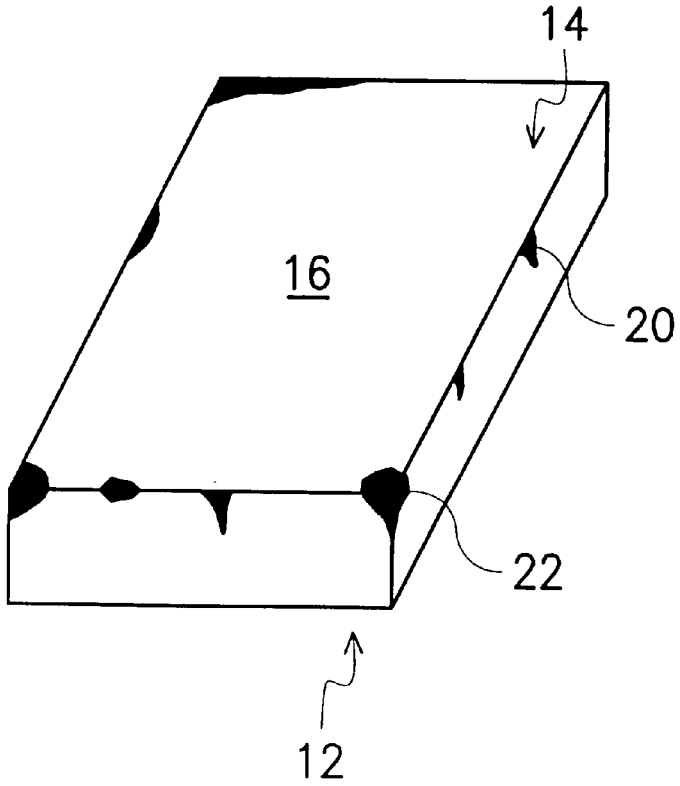
FIG. 2 is a perspective view of one of the silicon chips in the wafer shown in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 3:
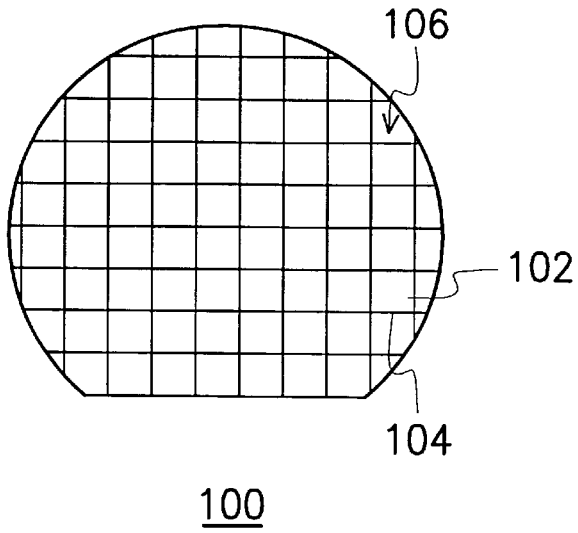
FIG. 3 is a schematic top view of a silicon wafer.
Figure 4:
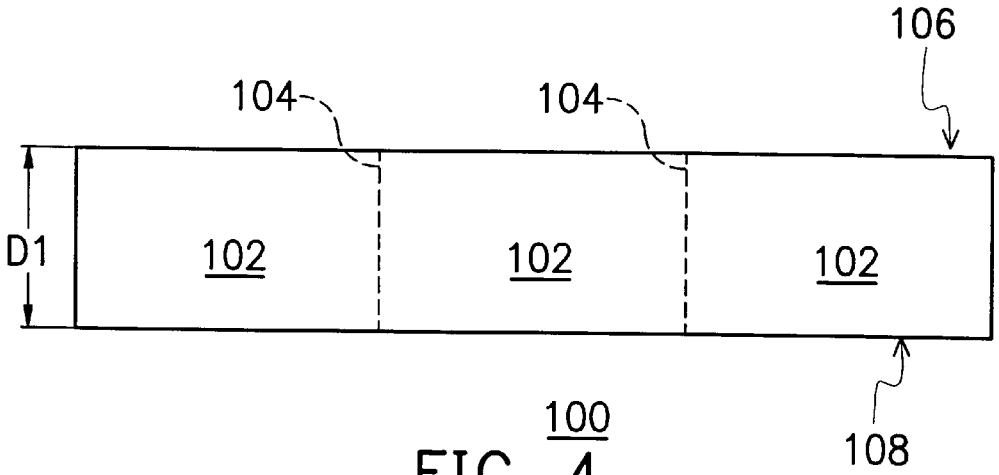
FIGS. 4 through 7 are schematic cross-sectional views showing the progression of steps in carrying out the wafer sawing/grinding process according to one preferred embodiment of this invention.

FIG. 3 is a schematic top view of a silicon wafer. FIG. 4 is a cross-sectional side view of a portion of the wafer according to FIG. 3. As shown in FIGS. 3 and 4, the wafer 100 consists of a plurality of silicon chips 102. Each silicon chip 102 is separated from its neighbors by kerfs 104. The wafer 100 has two surfaces. The surface having devices, deposited layers, interconnections and bonding pads thereon is known as an active surface 106, while the other surface is known as a back surface 108.

FIGS. 4 through 7 are schematic cross-sectional views showing the progression of steps in carrying out the wafer sawing/grinding process according to one preferred embodiment of this invention. The wafer sawing/grinding process is performed after the active surface 106 has been formed. In other words, the process is carried out after all the manufacturing steps necessary for forming devices, deposited layers, interconnections, bonding pads and passivation layers are completed. As shown in FIG. 4, the wafer 100 has a thickness D1 of between 700 to 800 micrometers.

Figure 5:
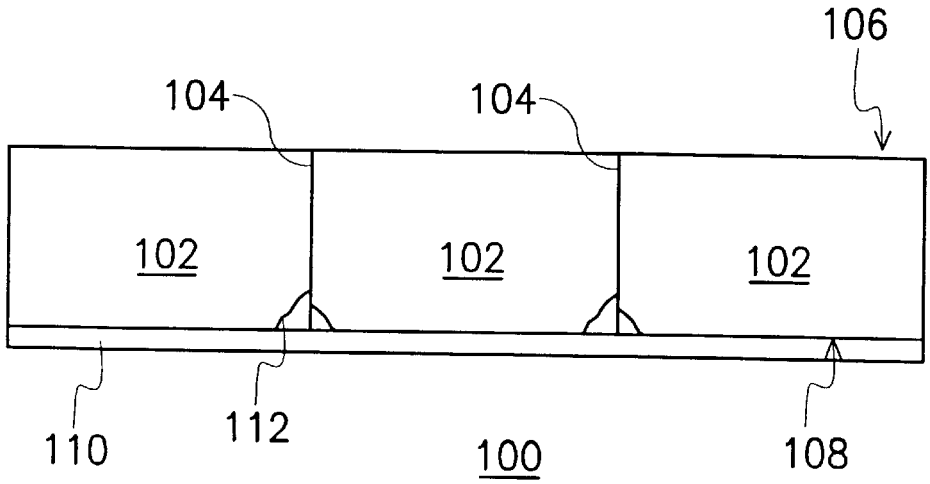

As shown in FIG. 5, a first tape 110 is attached to the back surface 108 of the wafer 100. The first tape 110 can be made of, for example, polyolefinic synthetic resin. The silicon chips 102 within the wafer 100 are separated by a sawing operation. The wafer is sawn by running a sawing blade from the active surface 106 towards the back surface 108 along the kerfs 104 between silicon chips 102. Because the wafer 100 is subjected to pressure along the kerfs 104 during the sawing operation, cracks are likely formed along the kerfs 104 near the back surface 108. The wafer 100 can be sawn to a depth equivalent to or slightly greater than the thickness of the wafer 100. However, the sawing blade must not go too deep as to cut through the first tape 110. Indeed, a sawing depth smaller than the thickness of the wafer 100 is also feasible. In other words, neighboring silicon chips 102 are not entirely separated at first. The silicon chips are still linked together by narrow bridges of silicon which are only removed in a subsequent grinding operation. However, the sawn depth must be deep enough to permit the removal of attached portions by the subsequent grinding operation.

Figure 6:
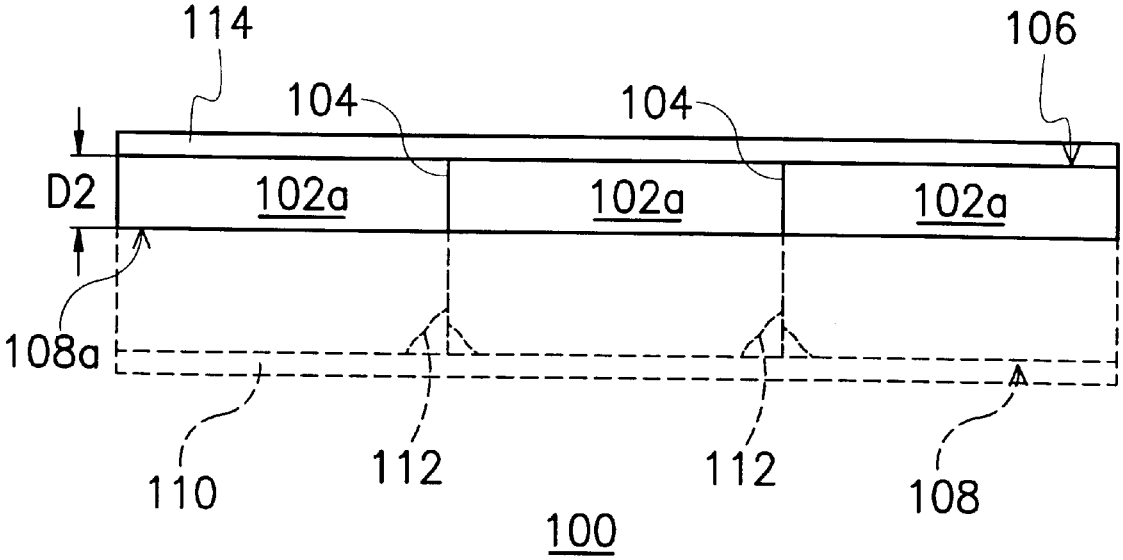

As shown in FIG. 6, a second tape 114 is attached to the active surface 106 of the wafer 100 so that the separated chips 102 fixed in position. The first tape 110 on the back surface 108 of the wafer 100 is then peeled off. The second tape 114 can be formed of the same type of material as the first tape 110. After the sawing and the tape-peeling operations, the wafer is usually cleaned. The back surface 108 of the wafer 100 is next ground using a grinding wheel to reach a thickness D2. The surface of the grinding wheel contains a large number of fine diamond particles joined together by a resinous binder. In order to enclose a silicon chip entirely inside a thin package, a thickness D2 of the silicon chip must be roughly between 100 to 200 micrometers. Because the grinding operation is carried out only after the wafer is sawn, cracks 112 and chipping normally formed during sawing can be completely removed. Without cracks and chipping on the back surfaces 108*a* of silicon chips 102*a,* the quality of ultimately formed chip packages can be improved.

Figure 7:
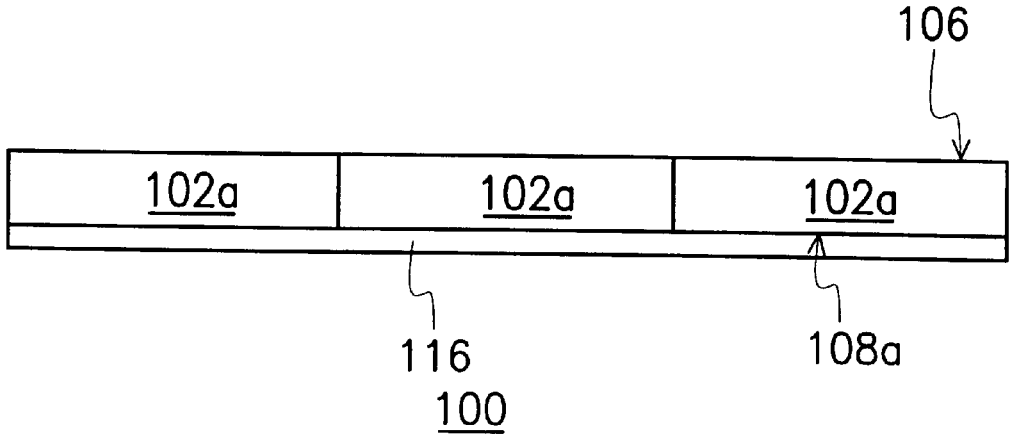

In FIG. 7, a third tape 116 is attached to the back surface 108*a* of the wafer 100 so that the separated chips 102*a* are fixed in position. The second tape 114 on the active surface 106 of the wafer 100 is peeled off to finish the wafer sawing/grinding process of this invention.

In summary, the wafer sawing/grinding process of this invention at least includes the following advantages:

1. Since the grinding of wafer back surface is performed after the wafer is sawn, cracks and chipping produced during wafer sawing can be removed by grinding. With the removal of cracks and chipping, heat dissipated performance of the chip can be increased when its back surface is exposed in a package. Therefore, the quality and reliability of a chip package can be improved.

2. Conversely speaking, since wafer sawing is carried out before back surface grinding, the wafer is at its original thickness when the wafer is sawn. Consequently, large cracks and chipping capable of affecting the ultimate operation of a silicon chip are rarely produced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wafer sawing/grinding process, comprising the steps of:

providing a wafer that has an active surface and a back surface, wherein the wafer includes a plurality of silicon chips with kerfs separating each chip;

sawing the wafer along the kerfs from the active surface; and grinding the back surface of the wafer to form a ground wafer having a desired thickness.

2. The process of claim 1, wherein before the step of sawing the wafer, further includes attaching a first tape onto the back surface of the wafer, and after the wafer sawing step, includes attaching a second tape onto the active surface of the wafer and removing the first tape.

3. The process of claim 1, wherein the wafer sawing step includes cutting a depth roughly equivalent to the wafer thickness.

4. The process of claim 1, wherein the wafer sawing step includes cutting a depth greater than the wafer thickness.

5. The process of claim 1, wherein the wafer sawing step includes cutting a depth smaller than the wafer thickness but greater than the desired thickness of the ground wafer.

6. The process of claim 1, wherein the desired thickness of the ground wafer is smaller than the wafer thickness.

7. A wafer sawing/grinding process, comprising the steps of:

providing a wafer that has an active surface and a back surface, wherein the wafer includes a plurality of silicon chips with kerfs separating each chip;

attaching a first tape onto the back surface of the wafer;

sawing the wafer along the kerfs from the active surface;

attaching a second tape onto the active surface of the wafer and removing the first tape;

grinding the back surface of the wafer to form a ground wafer having a desired thickness; and attaching a third tape onto the back surface of the ground wafer and removing the second tape.

8. The process of claim 7, wherein the wafer sawing step includes cutting a depth roughly equivalent to the wafer thickness.

9. The process of claim 7, wherein the wafer sawing step includes cutting a depth greater than the wafer thickness.

10. The process of claim 7, wherein the wafer sawing step includes cutting a depth smaller than the wafer thickness but greater than the desired thickness of the ground wafer.

11. The process of claim 7, wherein the desired thickness of the wafer is smaller than the wafer thickness.

* * * * *